US006575685B2

(12) United States Patent
Baxter, Sr.

(10) Patent No.: US 6,575,685 B2
(45) Date of Patent: Jun. 10, 2003

(54) HOISTING PLATFORM SYSTEM

(76) Inventor: Kern C. A. Baxter, Sr., 4517 SW. 1st Pl., Cape Coral, FL (US) 33904

( * ) Notice: Subject to any disclaimer, the term of this patent is extended or adjusted under 35 U.S.C. 154(b) by 0 days.

(21) Appl. No.: 09/924,908

(22) Filed: Aug. 8, 2001

(65) Prior Publication Data

US 2003/0029825 A1 Feb. 13, 2003

(51) Int. Cl.[7] ..... E04G 21/14

(52) U.S. Cl. ..... 414/10; 187/900; 212/179; 414/609

(58) Field of Search ..... 212/179; 187/900, 187/239, 240, 242; 414/10, 11, 12, 609, 610

(56) References Cited

U.S. PATENT DOCUMENTS

| | | | | | |
|---|---|---|---|---|---|
| 24,925 | A | * | 8/1859 | Bower | |
| 112,855 | A | * | 3/1871 | Scott | |
| 197,709 | A | * | 11/1877 | Winkless | |
| 236,676 | A | * | 1/1881 | Gee | |
| 1,562,781 | A | * | 11/1925 | Moser | |
| 2,830,720 | A | * | 4/1958 | Figge | |
| 3,341,034 | A | * | 9/1967 | Blasen | |
| 3,763,964 | A | * | 10/1973 | Davis | 187/2 |
| 3,831,712 | A | * | 8/1974 | Neely et al. | 187/2 |
| 4,496,277 | A | * | 1/1985 | Jungman | 414/589 |
| 4,733,896 | A | * | 3/1988 | Klein | 294/67.1 |
| 4,951,779 | A | * | 8/1990 | Tseng | 182/14 |
| 4,962,828 | A | * | 10/1990 | Duncan | 182/82 |
| 5,101,935 | A | * | 4/1992 | LaBianca | 182/236 |
| 5,135,078 | A | * | 8/1992 | Bell et al. | 182/142 |
| 5,935,437 | A | * | 8/1999 | Anson | 193/15 |

FOREIGN PATENT DOCUMENTS

| | | | | |
|---|---|---|---|---|
| DE | 360359 | * | 10/1933 | 414/609 |
| SU | 116804 | * | 3/1958 | 414/10 |

* cited by examiner

*Primary Examiner*—Thomas J. Brahan

(57) ABSTRACT

The invention pertains to a hoisting platform system which is usable in the construction of high rise buildings Included in the system are two I-beams which are mounted on a higher floor of the building under construction which has been finished already. The two I-beams are mounted in a cantilevered fashion with one section jutting forward from the higher floor and another section being attached to the higher floor by several post jacks on top of the I-beams and against the ceiling of the next higher floor. On the forward section there is mounted a pair of A-frames having a cross beam mounted at their tops which in turn has a winch mounted thereon. A movable transfer deck is located between the I's of the two I-beams and can be moved to a position interior of the building once a load is placed thereon. The winch can also be located on the higher floor and idler sheaves can be used on top of the cross beam. The winch is a hydraulic winch which is powered by a hydraulic pump which in turn is powered by an internal combustion engine. There a variations of the A-frames, because a pair of single support struts can be used, which are articulated relative to the two I-beams.

24 Claims, 10 Drawing Sheets

HOISTING PLATFORM SYSTEM

CROSS REFERENCE TO RELATED APPLICATIONS (none)

STATEMENT REGARDING FED SPONSORED R & D (none)

REFERENCE TO MICROFICHE APPENDIX (none)

BACKGROUND OF THE INVENTION

The invention pertains to a hoisting platform system, particularly to a hoisting platform system that is used in the construction of high rise buildings. There are various power cranes and platform hoists that are known and are useful in the construction of high rise buildings while under construction. One such crane is known as an aerial platform crane or as a platform crane. This crane is only useful to place building material on top of the rising building or in conjunction with outrigger platforms that jut out from the various concrete slabs already constructed. The load that has been picked up by the platform crane is lowered on to such a platform and the material is then moved inside of the building by hand or by various moving implements such as dollies, hand trucks etc.

Another type of crane is movable on the ground and can be placed at different locations. Such a crane has an extendible boom that can be swung to various locations and again operates in conjunction with the above mentioned outrigger platforms.

Still another hoisting crane is known as the "buck hoist" which has a static tower attached to the building with the tower having a pulley at the top over which a cable will run which in turn is attached to a cage. The cage can transport personal as well as material. The operator is located on the ground and is operating a winch which in turn will lift or lower the cage on command.

All of the above mentioned cranes have the disadvantage in that the operator of any of the cranes is always located remote from where the load is to be deposited on any of the concrete slabs at any height of the building. This fact involves a lot of guess work or another person to signal when exactly the descending load is in place or when the cage has reached a correct position. Another disadvantage is that the cranes are always busy and there is always a time lag between and when a particular load can be transported. Some of the cranes can only be operated under electric power which limits the load capacity.

U.S. Pat. No. 683,624 shows a crane assembly that operates inside a building under construction including a tower structure. A cable runs over two adjacent pulleys on top of the tower and the cable ends are attached to two hoisting platforms that operate in tandem.

U.S. Pat. No. 2,364,224 discloses a hoisting means which can be quickly and easily attached to a building window structure and can be employed for lifting articles such as storm windows up or down from an upper story.

U.S. Pat. No. 3,827,744 illustrates a hoisting cage that can contain various building materials to be lifted to any higher floors. The cage can be lifted by a tower crane or by a mobile crane on the ground. The cage has a ramp plate that can be lowered onto the concrete slab so that the load can be rolled out of cage and onto the concrete slab.

U.S. Pat. No. 3,876,099 discloses equipment that is useful for delivering materials to elevated floors of a building under construction. The equipment includes a frame adapted to be lifted by a construction crane having an overhead cable. The frame has bars for engaging a building floor to position the frame against the side of the building. The bottom of the frame or cage has a plurality of rollers that are instrumental in helping the load to be moved from the frame to the concrete slab.

U.S. Pat. No. 5,575,356 illustrates a platform hoist that is guided in two parallel and vertical support beams. The platform can be guided by wheels in slotted support beams. The wheels allow to load to be rolled into the building and onto the concrete slab once a predetermined height of a floor is reached.

BRIEF SUMMARY OF THE INVENTION

An object of the invention is to simplify the delivering of the building materials in a high rise building under construction. This is accomplished by supporting two I-beams in parallelism to each other on a concrete slab of a building. A moving platform can move into the building with a load thereon or out of the building to receive a new load. The winch and the power supply for the winch to operate a hoisting cable is located on the same floor where the I-beams and the moving platform is located. In this manner, the winch cable can be lowered to the ground to pick up a new load while the just delivered load can be unloaded inside the building. This will shorten the waiting period of other loads to be lifted considerably. It is also possible to service lower floors provided other I-beams are located as outriggers on the lower floors. This is possible because once the moving platform has moved inside the building, there is no obstruction between the I-beams to hinder further operations. All of the necessary equipment and the various elements of the hoisting platform can easily be assembled and disassembled and moved to a different location. The hoisting power is preferably derived from a hydraulic power supply because of its superior energy force although electric power can be used too. The power supply is generated in the same location where the winch is located such as a diesel engine driving a hydraulic pump or an electric generator. Another advantage of the above described hoisting platform is that the operator is in close proximity to where the loads are to be deposited, whereby the operator has direct eye contact with the activities at their most critical moments.

DETAILED DESCRIPTION OF THE INVENTION

Figure 1:
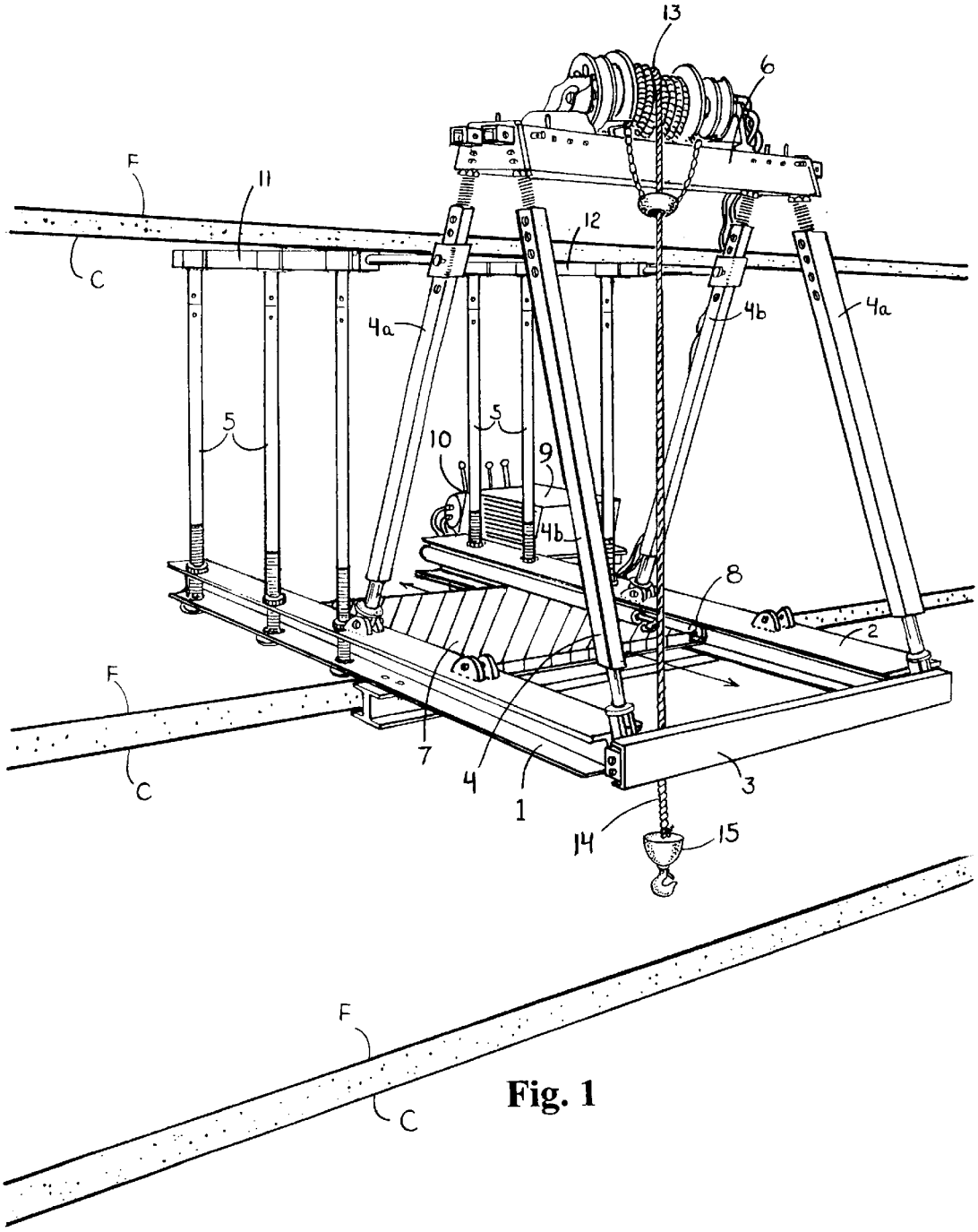
FIG. 1 Is a perspective view of the hoisting platform installed.

Turning now to FIG. 1 which shows a perspective view of the hoisting platform including two I-beams 1 and 2 which are placed on a concrete slab F and are jutting forward in a cantilever fashion. The forward ends are connected to each other by a beam 3 (either an I-beam or a block beam) so that they cannot spread apart, although other arrangements can be made as will be shown below. The two I-beams 1 and 2 are supported on the floor F by several post jacks 5 which are placed against the ceiling C and are under pressure there against. It is helpful to add the beams 11 and 12 under the ceiling C and between the post jacks 5 so as to obtain an equal pressure distribution. The forward ends of the I-beams 1 and 2, the ends which are cantilevered over the concrete slab receive an A frame 4. The forward supports of the A frame are designated as 4*a* and the rearward supports are designated as 4*b*. This results in two forward struts 4*a* and two rearward struts 4*b* which can be of any configurations such as I-beams, block beams or L-shaped struts. The top of the A of the A frame carries a connecting beam 6 which will be described below in more detail. The connecting beam 6 carries or supports a winch 13 which preferably is of a hydraulic type because such a hydraulic winch delivers more power although other types may be used as will be described below. The power for the winch 13 is derived from a hydraulic pump 10 which is driven by an internal combustion engine 9 which can be a diesel or a gasoline engine. Between the two I-beams 1 and 2 there is located a transfer deck 7 which is supported by the two I-beams 1 and 2 by rollers 8 which will run in the inside I of the two I-beams 1 and 2. This way, any load that is placed on top of the transfer deck 7 can now easily be transported into the building and the load can be unloaded therefrom. This transfer can also be undertaken by using a power arrangement such as the piston 7*a* attached to one or both I beams and the piston rod 7*b* that is attached to the transfer deck 7 (shown in FIG. 2). The advantage of this is that the cable 14 with its hook 15 can now be lowered again through the vacated space between the two I-beams 1 and 2 and prepare to pick up another load to thereby gain valuable time between loads.

Figure 2:
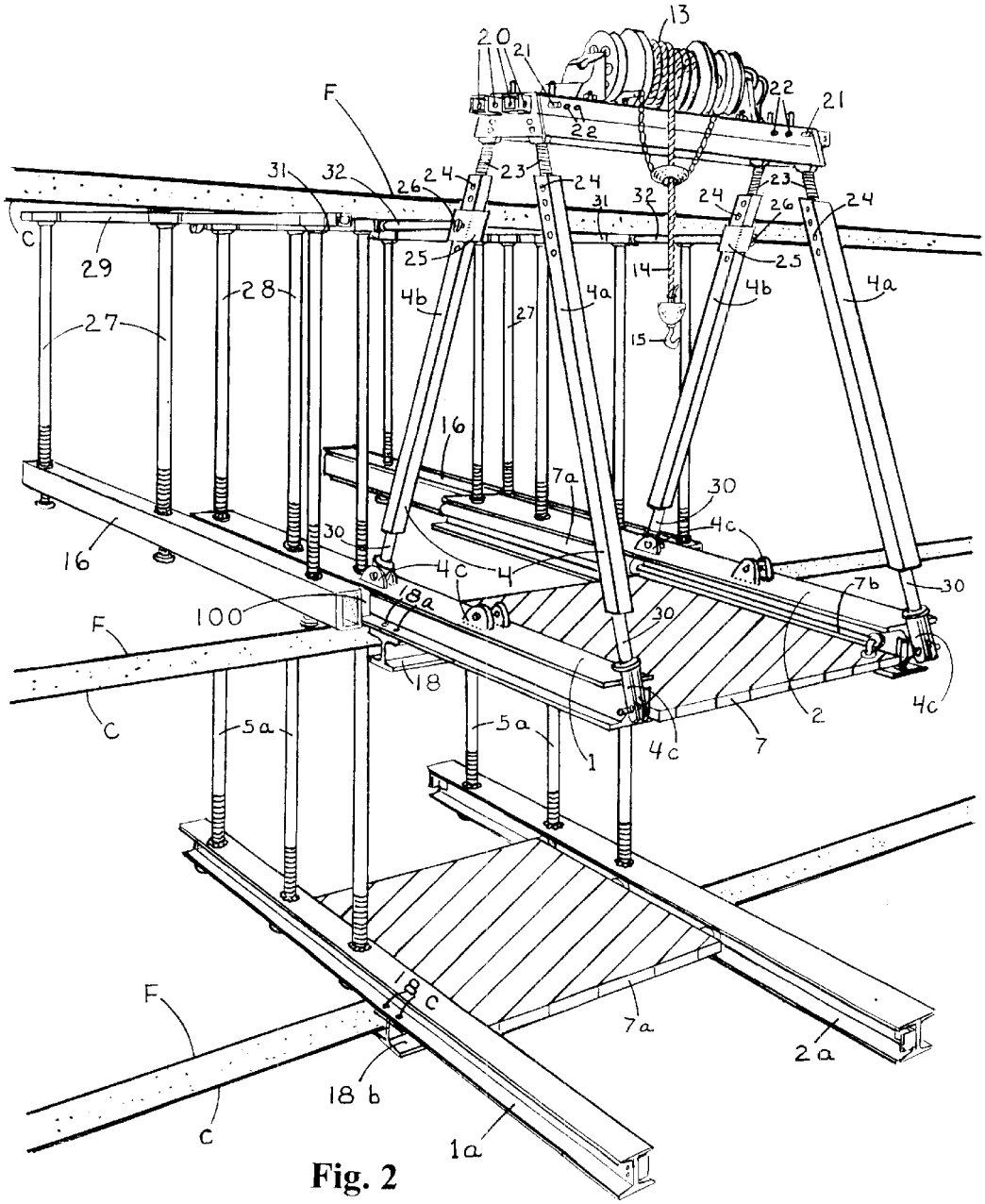
FIG. 2 Is a perspective view of a different installation shown in FIG. 1.

Turning now to FIG. 2 wherein the same reference characters have been used to identify the same elements that were identified in FIG. 1. This FIG. 2 again is a perspective view of the hoisting platform. In this embodiment, the two I-beams 1 and 2 have been reinforced or strengthened by two additional block beams 16 and 17. The Two I-beams 1 and 2 are connected to the block beams 16 and 17 by way of connecting blocks 100 (only one is shown). Also, the two block beams 16 and 17 receive their own post jacks 27 which are pressed against the ceiling C or through the intermediary top beams 29. Also, the I-beams 1 and 2 have their own post jacks 5 as was described with reference to FIG. 1. The post jacks 5 are pressed against the ceiling C or through the intermediary top beams 5, again as shown in FIG. 1.

FIG. 2 also shows an installation of a hoisting platform on a lower floor F. The two I-beam are shown as 1*a* and 2*a* with the post jacks 5*a* installed against the lower ceiling C. Also, there is shown the transfer deck 7*a* and an inner support beam 18*a* which is mounted on the bottom of the I-beams 1 and 2 by way of holes and bolts 18*b*. The same support beam is shown at 18 on the upper floor.

Turning now to the construction of the A-frame 4 which consists of the forward beams 4*a* and the rear beams 4*b* which are connected at their top by way of the top connecting beam 6 (FIG. 1) which in this embodiment consists of at least four block beams 20 which are connected to each other by way of holes 22 and pins 21. The holes 22 and pins 21 are essential so that lateral adjustments on the beams 20 can be undertaken. Each of the pair of the A-frame beams 4*a* and 4*b* are supported on the lower I-beam by way of knuckle joints 4*c*, which articulate each of the A-frame beams to the I-beams 1 and 2. Each of the A-frame beams 4*a* and 4*b* Have a height adjustment by way of the pistons 30. Also, there is further incremental height adjustment at the top of the A-frame beams 4*a* and 4*b* by way of screw threads shown at 23. The top of the A-frame beams 4*a* and 4*b* is adjustably supported in the plane of the ceiling C by way of pistons 32 and piston rods 31 extending therefrom to cooperate with a sliding joint 25. The sliding joint 25 changes its position on each of the rearward A-frame beams 4*b* as the A-frame moves up or down or out or in. Once the right position has been found, the sliding joints 25 can be arrested in a certain position by way of the holes 24 and the pins 26. Also the A-frame 4 can be moved in and out relative to the building slab F/C by way of the piston rods 31 which are each operated by the pistons 32. Each of the pistons 32 are either attached to the bottom of the ceiling C or to the upper beam 29 which is pressed against the ceiling C because of the pressure caused by the post jacks 27 or 5.

The height of the forward front beams 4*a* and the rear beams 4*b* can also be adjusted in two ways. One way is shown at 23 by using screw threaded rods 23 at the top of the beams 4*a* and 4*b* and the other way is shown at the bottom of the beams 4*a* and 4*b* by way of piston rods 30. In the structure shown in FIG. 1 there is shown a front support beam 3 which has been omitted in FIG. 2. Instead a bottom support beam 18 has been attached below the two I-beams 1 and 2 and right in front of the concrete slab F/C. The presence of the holes 18*a* allows for a lateral adjustment of the beam 18 relative to the two I-beams 1 and 2. The same arrangement can be seen at the installation of a lower hoisting platform with the lateral support beam at 18*b* and the holes 18*c* for the bolts.

Also FIG. 2 shows a cylinder 17*a* which is connected to the transfer deck 7 by way of the piston rod 7*b*. This arrangement eliminates the use of manual power to move the transfer deck 7 from a load receiving position on the cantilevered I-beams 1 and 2 to the unloading position in the interior of the building. A mere push of a button accomplishes this task.

In the installation in FIG. 2, it can now be seen that the loading time between loads has greatly been accelerated in a very simple and efficient manner. When a load has been deposited on the upper transfer deck 7 and it has not been quite unloaded, a new load can be deposited on the lower transfer deck 7*a* already without any interference from the upper transfer deck 7 which has simply vacated the spacing between the two I-beams 1 and 2.

Figure 3:
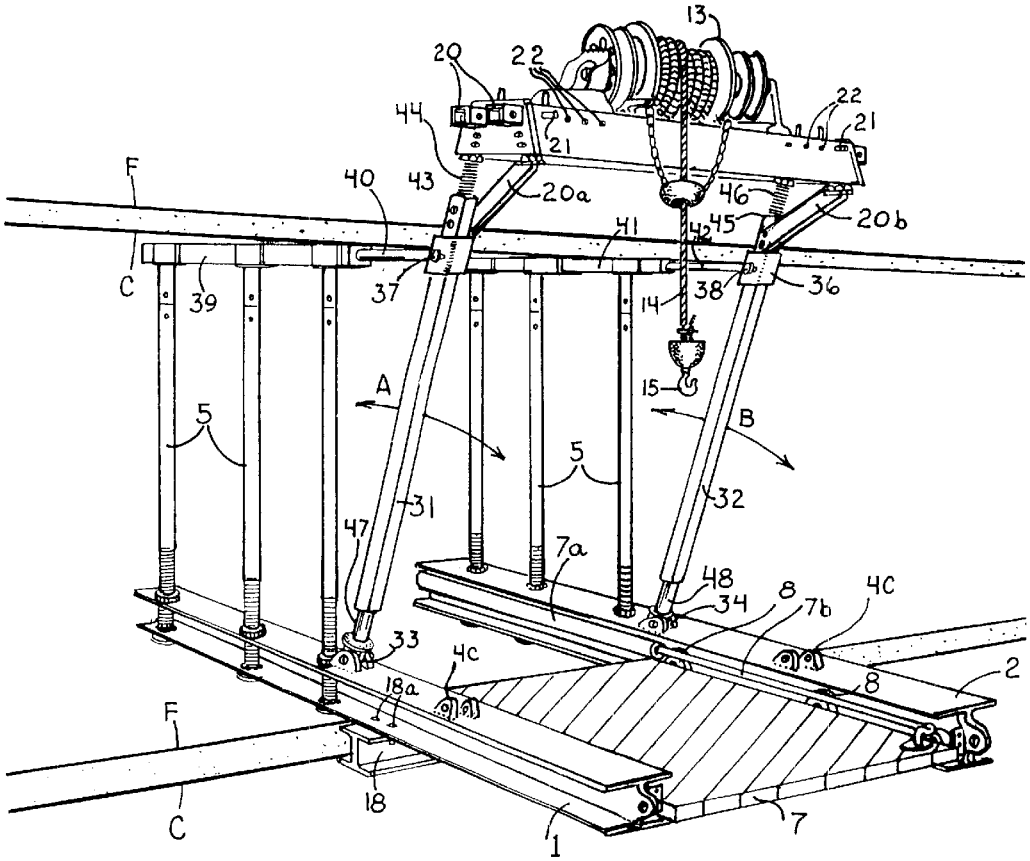
FIG. 3 Is a perspective view of still a different installation of FIG. 1.
Figure 3:
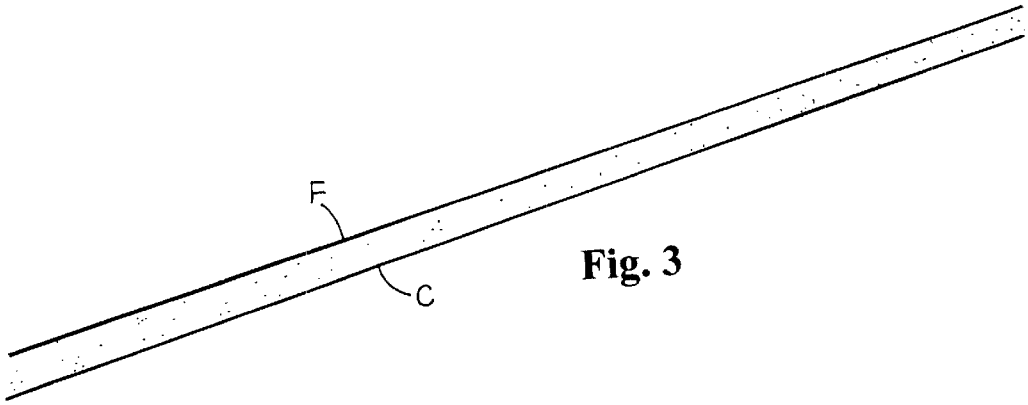

FIG. 3 shows still another installation of the support for the winch 13 which is located on the top beam 20. The same reference characters that were used in FIGS. 1 and 2 are again applied to the same elements. In this structure of FIG. 3, the A frame has been replaced by two single upstanding support beams 31 and 32. The support braces 20*a* and 20*b* have added because the top supporting beams 20 are installed in a cantilevered fashion whereby the braces 20*a* and 20*b* lend extra support to the structure. The upstanding support beams are somewhat inclined from the vertical and are adjustable relative to the vertical plane of the building as is shown by the arrows A and B. The adjustments are accomplished by the pistons 39 (left) and 42 (right) by way of their piston rods 40 (left) and 42 (right). The piston rods 40 and 42 are each articulated to each of the upstanding beams 31 and 32 by way of the sliding joints 35 (left) and 36 (right). Once a correct adjustment position has been found for each of the sliding joints 35 and 36, a pin 37 (left) and 38 (right) can each be inserted into each of the sliding joints to arrest the same relative to the support beams 31 and 32, respectively. Again, a height adjustment of the upstanding beams 31 and 32 is possible through the use of threaded rods 44 (left) and 46 (right) which are received in threaded sleeves 43 and 45, respectively at the top of the upstanding support beams 31 and 32. Also at the bottom of the upstanding support beams 31 and 32 there is a further possible height adjustment by way of the piston rods 47 (left) and 48 (right). The upstanding support beams 31 and 32 are articulated to the two I-beams 1 and 2 by way of the knuckle joints 33 (left) and 34 (right). The above described structure allows for a very quick and accurate adjustment of the winch 13 on top of the two upstanding beams 31 and 32 relative to the opening or available space between the two I-beams 1 and 2 or more accurate centering of the cable 14 with its hook 15 between the two I-beams 31 and 32.

Figure 4:
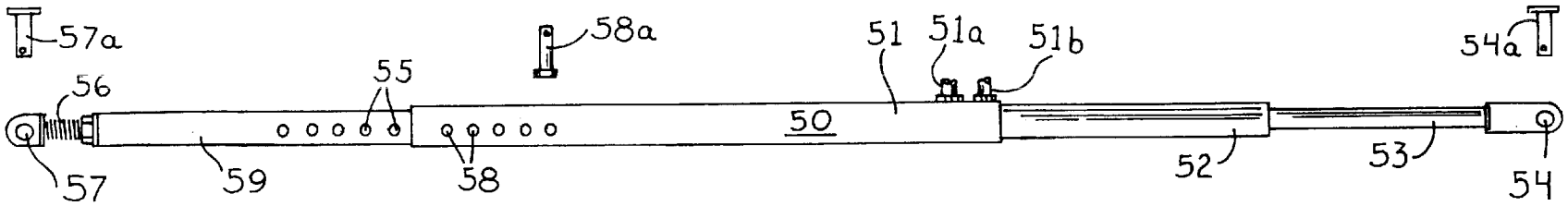
FIG. 4 shows a power cylinder for an adjustable frame.

Turning now to FIG. 4, there is shown an adjustable power cylinder that can be used in various instances where a multiple way of adjusting different elements is desired such as was discussed with reference to FIGS. 1–3. FIG. 4 shows a general adjustable power cylinder or adjustable support strut having an outer sleeve 50. The sleeve 50 has a piston cylinder 52 supported therein which has a piston rod 53 operating therein to extend in or out. The piston rod 53 also has an eyelet 54 at its outer end which may be attached to any element that needs any incremental adjustment. The inner end of the piston 52 also has an eyelet that my be adjustably attached to any position within the sleeve 51 by way of bores 58 and a pin (not shown) inserted therein. The other end of the outer sleeve 51 has a sliding sleeve 59 therein which may be adjustable relative to the outer sleeve 51 by way of the holes 55 receiving an arresting pin (not shown). The sleeve 59 which is received within the sleeve 51 has a threaded rod 56 therein which is adjustable by way of its threads relative to the inner sleeve 59. The threaded rod 56 has another eyelet formed at its outer end to be attached to any element in the structure of the overall hoisting platform, as was previously discussed.

Figure 5:
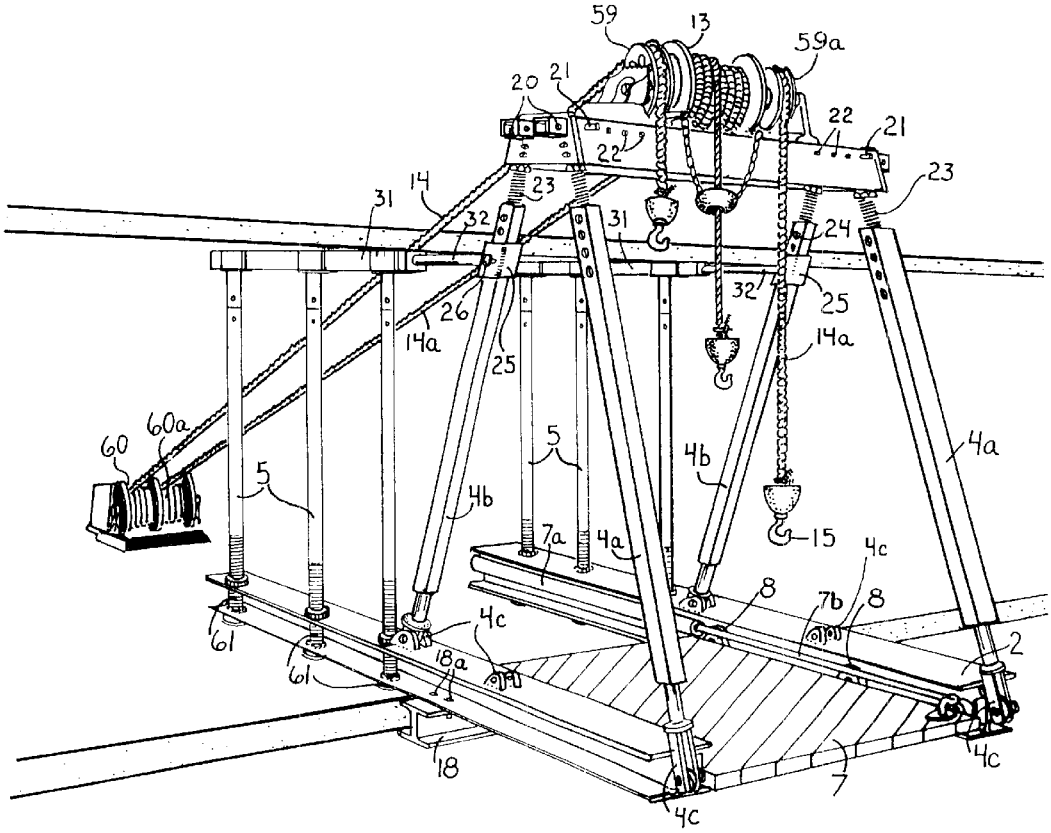
FIG. 5 shows a different power arrangement.

Turning now to FIG. 5 which shows a different power to load arrangement. In this respect, this FIG. 5 shows the relocation of the power implements. The same reference characters are being used to identify the same elements as were used in previous Figs. The support beam 20 on top of the A-frame 4 has now supported thereon idler sheaves 59 and 59*a* over which the both cables 14 and 14*a* will be guided. The twin winch 60 and 60*a*, which is to operate the cables 14 and 14*a* with the hook 15 thereon, is now located on the same floor F where the transfer deck 7 is located. This arrangement may simplify the above noted installation in that the weight of the hydraulic winch or any other type is being transferred to a more accessible location where the internal combustion engine is driving the hydraulic pump or the electric generator. The use of a twin winch has the advantage that lighter loads can be handled at the same time or successively involving lower floors. The winch 13 on top of the support beams 20 is idle in this arrangement but can be put into service at any time when the demand so dictates. It is merely a matter of connecting the various power lines or hoses.

Figure 6:
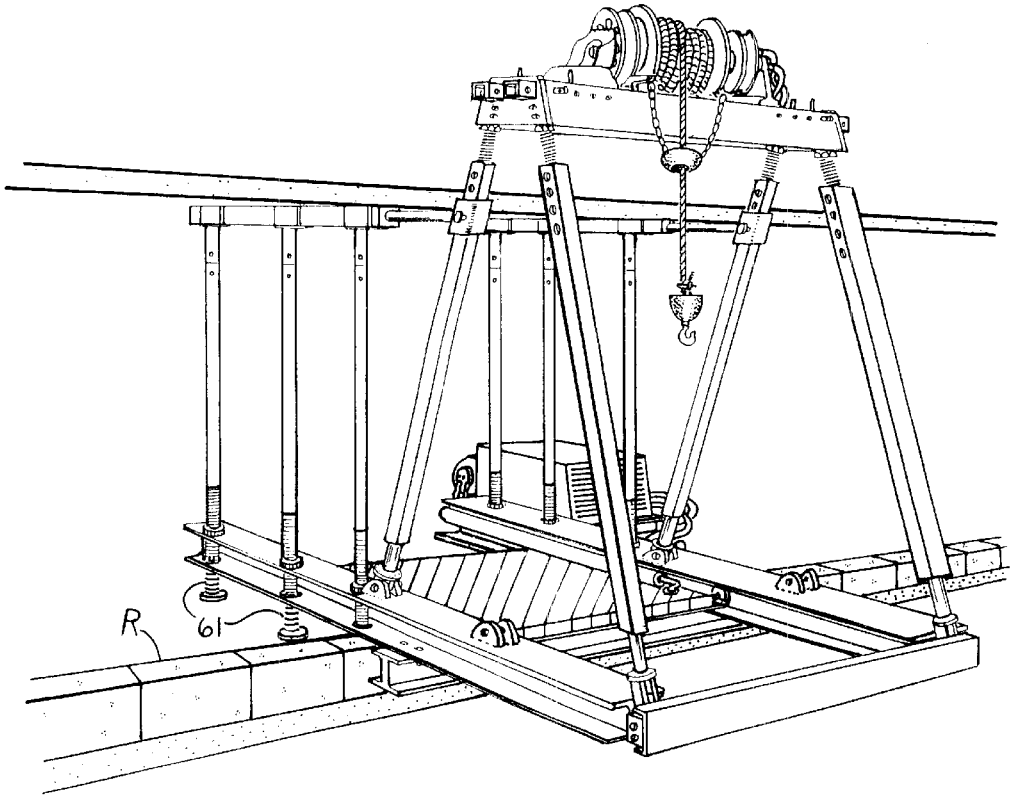
FIG. 6 shows a different way of mounting the movable platform.

FIG. 6 shows a different installation wherein the building on which the hoisting platform is installed offers a different type of variation in its general layout. In this case, the building structure has been modified to present a built-up curb or a riser R which is in line with the front of the concrete slab F/C. This installation presents an obstacle to the previously presented Figs. in that the previously installed I-beams 1 and 2 or the adjacent block beams 16 and 17 must be raised by the distance of the thickness of the curb or the riser R to compensate for this difference. In this instance, the post jacks 27 extend through the I-beams 1 and 2 or through the block beams 16 and 17, which ever the case may be, to an extent to form a foot support 61 equal of the thickness to make up for the rise of the curb or riser R. The remainder of this operation remains the same as was discussed with respect to FIGS. 1–3. also shown in FIG. 6 is a different support for the top beams 20 which are supported in a cantilevered fashion in a direction oriented toward the building. This is accomplished by the braces 20*b* mounted between the support beams and the movable struts 4*a*. The advantage of this arrangement is that a load can be deposited on the next higher floor without having to change the basic arrangement. This arrangement is possible because first of all, the supporting struts 4*a* can be moved to any position toward the building because the cylinders 31 with their respective piston rods 32 can move the supporting struts 4*a* to different vertical positions including over the next higher floor F. Also, the fact that the supporting struts 4*a* have at their bottom ends the installed the power pistons 30, the supporting struts 4*a* can be moved to a higher position to reach a greater height over the next higher floor to deposit a load thereon.

Figure 7:
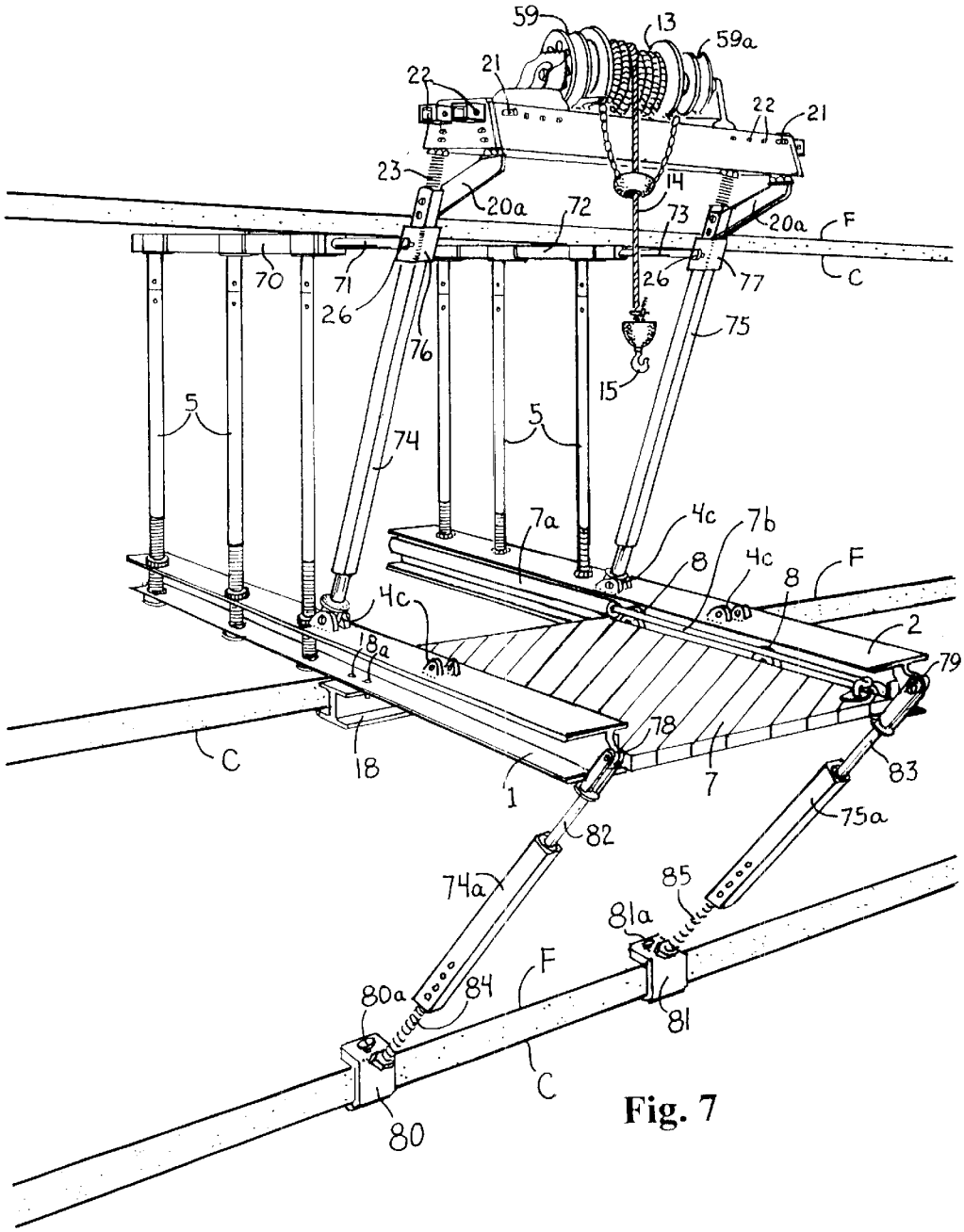
FIG. 7 shows a different way of supporting the movable platform.

In FIG. 7 there is shown a different version of supporting both the front ends of the I-beams 1 and 2 in that both the supporting struts 74 and 75 may be rotated to an entire different supporting position. Again, the same reference characters are applied to the same elements as were identified in FIGS. 1–6. To this end, the supporting struts 74 and 75 are supported on the I-beams 1 and 2 by way of knuckle joints 78 (left) and 79 (right) so as to be rotatable about their respective joints 78 and 79 to be able to make contact with the outer edge of the floor F below from where the hoisting platform is operating now. The rotated support struts are identified by the numerals 74*a* and 75*a*, respectively. This simple arrangement will simplify the operation of the overall system. The top of the supporting struts 74 and 75 are still adjustable relative to the distance between the upper concrete slab F by way of the pistons 70 (left) and 72 (right) and their respective piston rods 71 (left) and 73 (right). Both of the sliding joints 76 (left) and 77 (right) are linked to the respective support struts 74 and 75 so as to be able to move the support struts 74 an 75 out from the concrete slab F/C or closer to it. Again, the supporting struts 74*a* and 75*a* can be adjusted in their lengths by using the pistons 82 (left) and 83 (right) in the support struts 74*a* and 75*a*, respectively, and through the piston rods 84 (left) and 85 (right). As previously described, the supporting struts 74 and 75 can be rotated (Arrow B) by more than 180° around the knuckle joints 78 and 79, respectively, to a lower position wherein the rods 74*a* and 75*a* are now supporting the hoisting platform from a support from below. Once in this position, the support struts 74*a* and 75*a* are now supported on the lower floor by way of the clamping elements 80 (left) and 81 (right).

Figure 8:
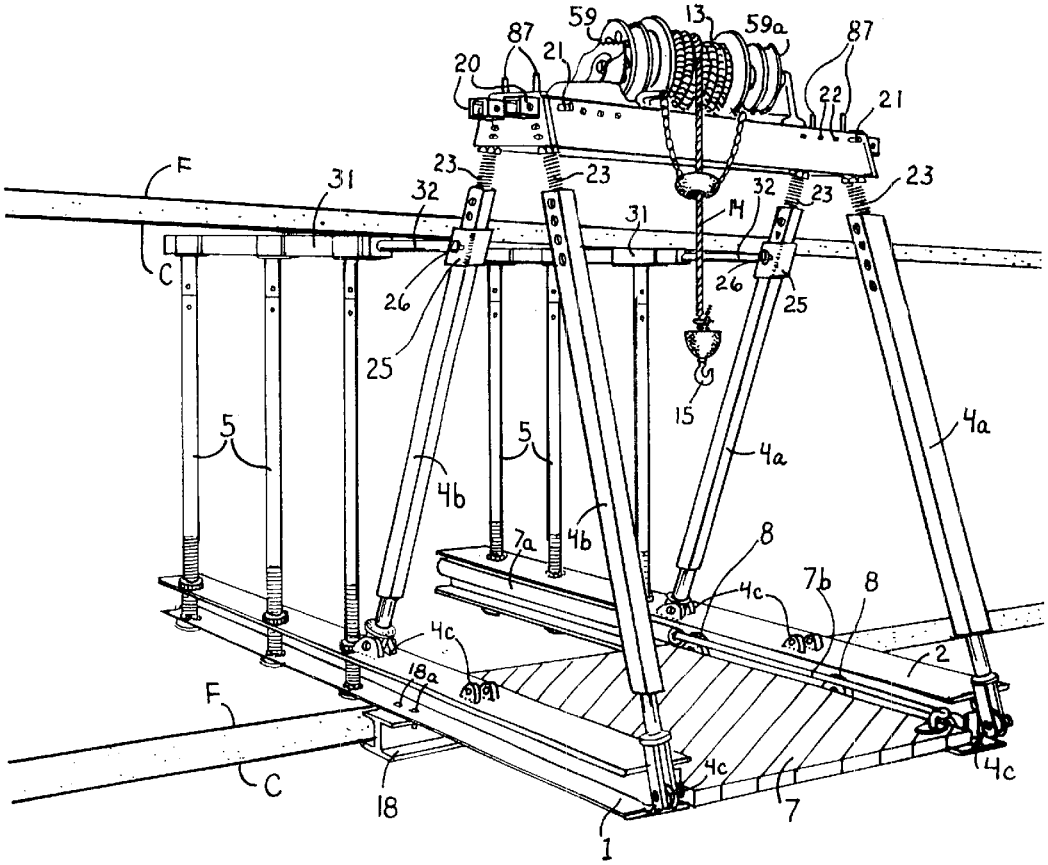
FIG. 8 shows a way of adjusting the width of the deck.

FIG. 8 shows a way of laterally adjusting the width or the space between the main supporting beams of the inventive structure. Again, the same reference characters have been applied to identify the same elements that were identified in the previous Figs. In this FIG. 8, the distance between the I-beams 1 an 2 can be adjusted by way of the lateral support beam 18 which can be moved to different adjustment bores 18*a* as is dictated by the distance. At the same time, there can be a front lateral support beam 18 which also can be adjusted by lateral adjustment holes 86. The various adjustments can be seen by the arrow C. At the same time, the top beam 20 needs to be adjusted with the adjustment made to the bottom I-beams which can easily be undertaken by the pins 87 which will fit into holes in the square tubing 20 as is dictated by the required distance between the I-beams 1 and 2 and, of course the distance between the forward struts 4*a* of the overall structure. Still referring to FIG. 8, it is clear when the lateral adjustments or the space between the two I-beams 1 and 2 is changed that a different width transfer deck 7 will have to used because the width of the transfer deck cannot be changed due to structural reasons.

Figure 9:
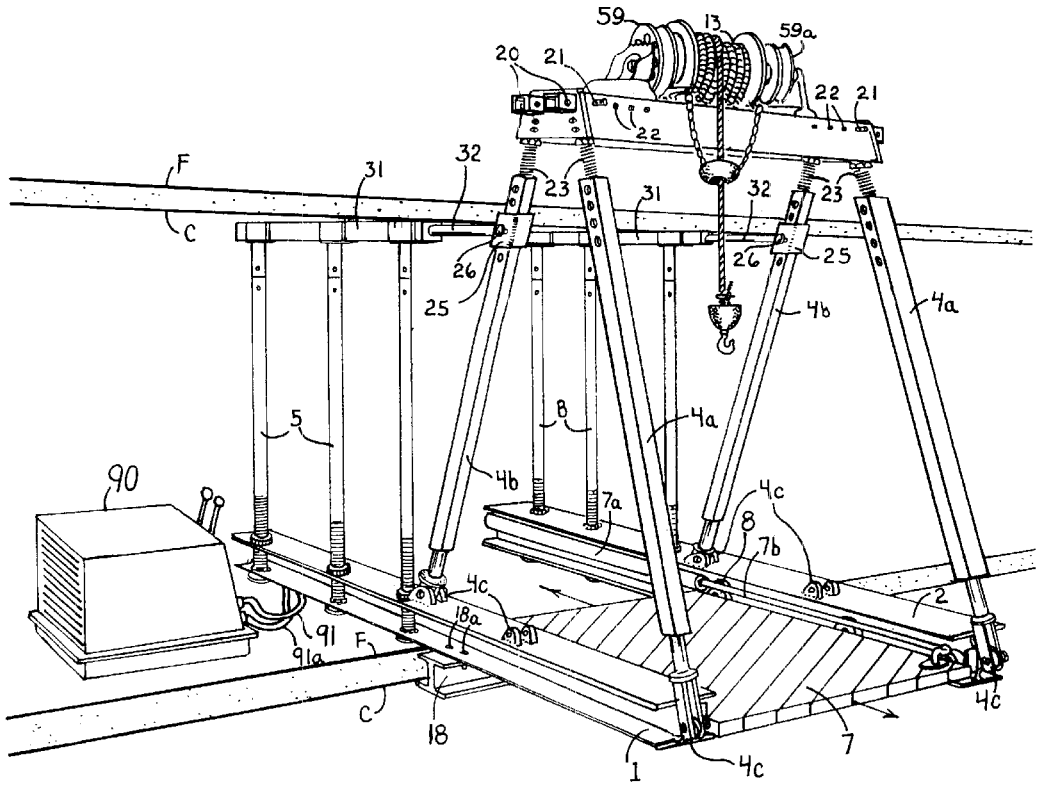
FIG. 9 places the power supply on a different floor.

FIG. 9 schematically shows the previous discussed structural arrangement and therefore, the same reference characters are again applied to the same elements. A difference in this illustration is that the power unit 90 is located on a different floor than where the transfer deck 7 is located. It was mentioned above, that the power unit 90 consists of an internal combustion engine and a driven hydraulic pump or an electric generator attached thereto. This particular unit does not have to be on the same floor where the loading or unloading operations take place. It could well be on a floor above or below the operations floor. The generated power would simply be supplied by the electric power cable 91 or by the hydraulic power or air power hoses 91*a*. This particular arrangement again contributes to the overall versatility of the hoisting platform. For example, if the present hoisting platform is operating on a given floor and the future projection is that the hoisting platform has to operate on the next upper floor, the power generating unit 90 does not have to be moved and can be left on the present floor which results in saving of time and effort.

Figure 10:
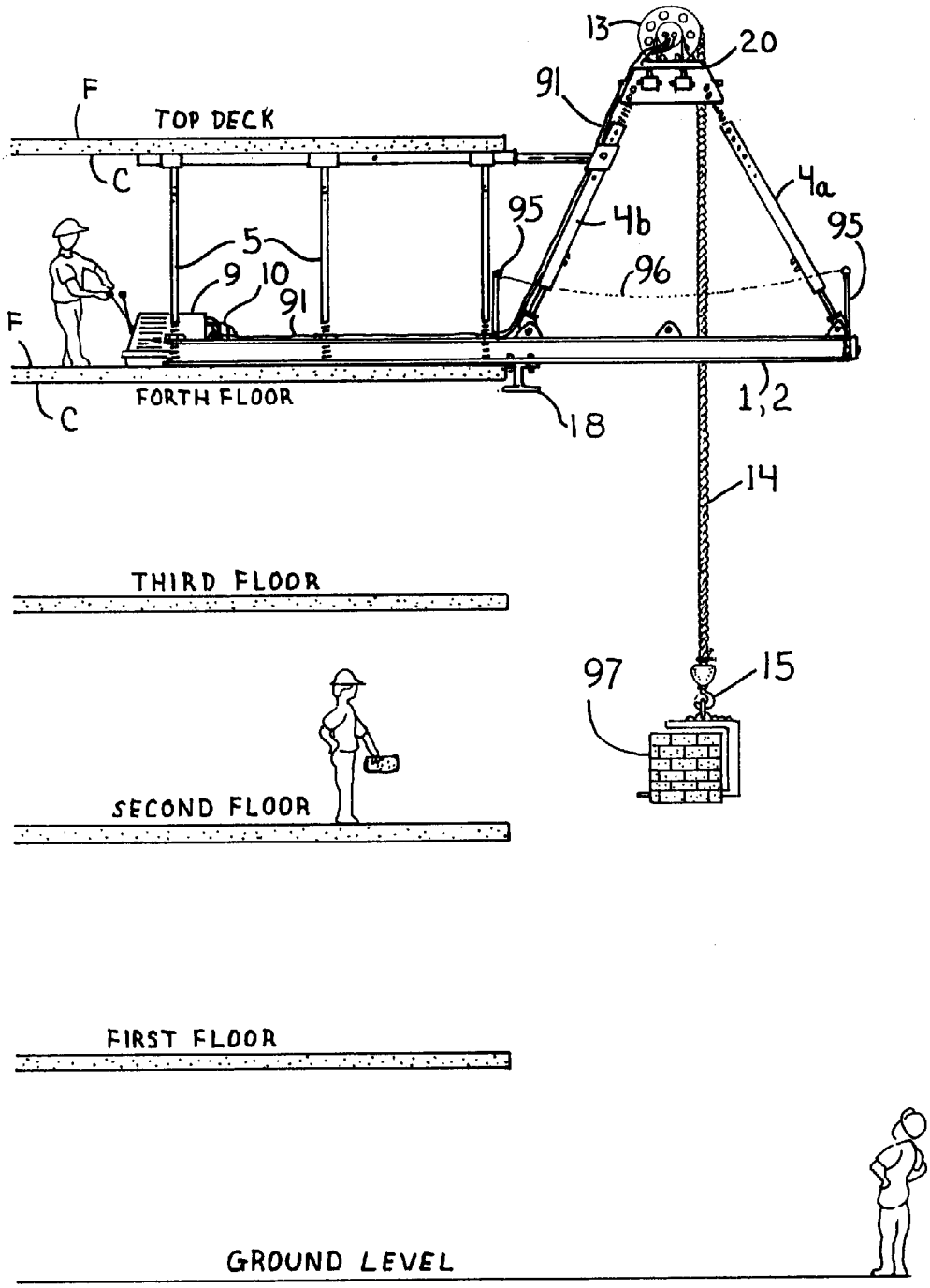
FIG. 10 is a side view of the hoisting platform.

FIG. 10 shows a side elevation view of the hoisting platform installed on a fifth floor, for example. Again the same reference characters have bee applied to the same elements that were discussed in previous Figs. In this Fig. the hydraulic winch 13 is located on top of the beam 20 on top of the A-frame 4. FIG. 5 described the instance where the winch 13 is located on the floor F but the cable 14 is trained over the idler sheaves 59. The cable 14 is attached to a load 97 by way of the hook 15. Also, the walkway of the I-beams is protected by a chain or similar arrangement which chain 96 is attached to stanchions 95.

What I claim is:

1. A hoisting platform system adapted to pick up a load on the ground and to deliver the load to a higher floor of a building under construction, said system including at least two stationary I-beams installed on said higher floor, said I-beams jutting forward from an edge of said higher floor in a cantilever fashion and having forward sections and rear sections, said rear sections of said I-beams are attached to said higher floor, means for mounting a winch above said I-beams and above said forward sections and attached thereto, means for supplying power to said winch from a location remote from said winch, a transfer deck movably mounted between said I-beams from said forward section to a rear position which is interior of the building.

2. The hoisting platform system of claim 1, wherein said means for mounting said winch above said I-beams includes a pair of A-frames attached to each of said of said I-beams, a cross beam mounted on top of each of said pair of A-frames, said cross beam having said winch mounted thereon.

3. The hoisting platform system of claim 2, wherein said top cross beam on top of said A-frames includes a multiple of box beams each fastened to each other by pins penetrating through bores in said box beams.

4. The hoisting platform system of claim 3, wherein said multiple of box beams are adjustable relative to each in various positions along a length of said box beams.

5. The hoisting platform system of claim 2, wherein each leg of said pairs of said A-frames is mounted to each of their respective I-beams by way of articulated joints.

6. The hoisting platform system of claim 2, wherein each leg of said pairs of said A-frames has adjustable screw threaded connections at their respective top ends.

7. The hoisting platform system of claim 2, wherein each leg of said pairs of said A-frames have hydraulic cylinders at their respective bottom ends.

8. The hoisting platform system of claim 2, wherein rear legs of each of said A-frames have each a hydraulic cylinder connection with an underside of a ceiling above said higher floor.

9. The hoisting platform system of claim 2, wherein the distance between said two I-beams and the distance between the tops of said pair of A-frames having said cross beam thereon are adjustable relative to each other.

10. The hoisting platform system of claim 2, wherein another winch is located on a surface of said higher floor and at least and at least one idler sheave is located on said cross beam.

11. The hoisting platform system of claim 10, wherein said another winch is driven by a hydraulic pump in tandem with or independently from said winch.

12. The hoisting platform system of claim 10, wherein said another winch is driven by a hydraulic pump which in turn is driven by an internal combustion engine.

13. The hoisting platform system of claim 1 including a beam mounted in front of said I-beams to avoid a spreading of said I-beams.

14. The hoisting platform system of claim 1 including a beam mounted under said I-beams in front of said concrete slab of said higher floor to prevent a spreading of said I-beams.

15. The hoisting platform system of claim 1, wherein said rear sections of said I-beams are attached to said higher floor by way of post jacks having means for pressing said I-beams against said higher floor and against the ceiling of the next higher floor.

16. The hoisting platform system of claim 1 including a box beam located adjacent to and straddling each of said I-beams and fastened thereto, said box beam is fastened to said higher floor and to a ceiling of the next higher floor by way of post jacks pressing said box beam against said higher floor and said ceiling.

17. The hoisting platform system of claim 1, wherein said means for mounting said winch above said I-beams includes at least two support struts, said support struts having a cross beam at their respective tops and having said winch mounted thereon.

18. The hoisting platform system of claim 17, wherein each bottom end of each of said support struts is mounted on top of each of their respective I-beam by way of knuckle joints at or near a front of said higher floor.

19. The hoisting platform system of claim 18, wherein a second pair of support struts is provided at a front of said I-beams, said second pair of support struts is mounted to said I-beams by way of knuckle joints, said second pair of support struts is oriented downwardly and is fastened to a front of the next lower floor from said higher floor.

20. The hoisting platform system of claim 17, wherein each top of each of said struts is movably attached to the floor above said higher floor by way of a piston and piston rod arrangement.

21. The hoisting platform system of claim 17, wherein said cross beam is mounted on top of said support struts in a cantilever fashion by way of braces, each of said braces is connected between said support strut and said cross beam.

22. The hoisting platform system of claim 1, wherein said means for mounting said winch above said I-beams includes at least two support struts, each bottom end of said support struts is attached to a front of each of said I-beams, each top of each of said support struts is supporting a cross beam having said winch mounted thereon.

23. The hoisting platform system claim 22, wherein each top of each of said support struts is connected to the next higher floor by way of a piston and piston rod arrangement.

24. The hoisting platform system of claim 1, wherein another winch is mounted on said higher floor and a cable coming from said winch is guided over at least one idler sheave mounted on said means for supporting said winch.

* * * * *